US006540441B1

(12) United States Patent
Foss et al.

(10) Patent No.: US 6,540,441 B1
(45) **Date of Patent: *Apr. 1, 2003**

(54) TRANSPORTER FOR INSTALLATION OR REMOVAL OF AN OFFSHORE PLATFORM AND A METHOD FOR REMOVAL OF AN OFFSHORE PLATFORM

(75) Inventors: Gunnar Foss, Den Hague (NL); Per Bull Haugsøen, Oslo (NO)

(73) Assignee: Marine Shuttle Operations AS, Sandnes (NO)

( * ) Notice: Subject to any disclaimer, the term of this patent is extended or adjusted under 35 U.S.C. 154(b) by 0 days.

This patent is subject to a terminal disclaimer.

(21) Appl. No.: 09/463,728

(22) PCT Filed: Aug. 3, 1998

(86) PCT No.: PCT/NO98/00230

§ 371 (c)(1),
(2), (4) Date: Oct. 26, 2000

(87) PCT Pub. No.: WO99/06271

PCT Pub. Date: Feb. 11, 1999

(30) Foreign Application Priority Data

Aug. 1, 1997 (NO) ..... 973561
Aug. 1, 1997 (NO) ..... 973562
Aug. 1, 1997 (NO) ..... 973563

(51) Int. Cl.[7] ..... B63B 35/00

(52) U.S. Cl. ..... 405/203; 405/195.1; 405/204; 405/205; 405/209; 114/260; 114/267; 114/44; 414/138.1

(58) Field of Search ..... 405/203, 204, 405/205, 206, 209, 195.1, 200, 219; 114/258, 259, 260, 125, 121, 44, 45, 50; 414/138.1

(56) References Cited

U.S. PATENT DOCUMENTS

| | | | | |
|---|---|---|---|---|
| 2,586,966 A | | 2/1952 | Ross et al. | |
| 3,054,267 A | | 9/1962 | Alcorn et al. | |
| 3,633,369 A | | 1/1972 | Lawrence | |
| 3,823,564 A | | 7/1974 | Crout et al. | |
| 3,859,804 A | | 1/1975 | Koehler et al. | |
| 3,987,637 A | | 10/1976 | Koehler | |
| 4,927,296 A | | 5/1990 | Raldenbach | |
| 5,111,764 A | | 5/1992 | D'Ettorre | |
| 6,209,474 B1 | * | 4/2001 | Foss et al. | 114/259 |
| 6,276,875 B1 | * | 8/2001 | Gunnar et al. | 405/203 |

FOREIGN PATENT DOCUMENTS

| | | | | |
|---|---|---|---|---|
| DE | 3219968 | | 5/1982 | |
| GB | 2165188 | | 6/1985 | |
| GB | 2343660 A | * | 8/1998 | B63B/35/00 |
| NO | 160424 | | 12/1982 | |
| NO | PS910358 | | 1/1991 | |
| WO | WO 9826978 | | 6/1998 | |
| WO | WO 9826979 | | 6/1998 | |
| WO | WO 9906270 | | 2/1999 | |

* cited by examiner

*Primary Examiner*—Thomas B. Will
*Assistant Examiner*—Alexandra K. Pechhold
(74) *Attorney, Agent, or Firm*—Birch, Stewart, Kolasch & Birch, LLP

(57) ABSTRACT

A transporter for removing an offshore platform has an oblong structure with a U-shaped cross section, rotatable by ballasting. The transporter is adapted to remove and carry both a jacket and a topsides simultaneously.

30 Claims, 4 Drawing Sheets

TRANSPORTER FOR INSTALLATION OR REMOVAL OF AN OFFSHORE PLATFORM AND A METHOD FOR REMOVAL OF AN OFFSHORE PLATFORM

This application is the national phase under 35 U.S.C. §371 of PCT International Application No. PCT/NO98/00230 which has an International filing date of Aug. 3, 1998, which designated the United States of America.

BACKGROUND OF THE INVENTION

1. Field of the Invention

The invention concerns a transporter for installation or removal of an offshore platform comprising a jacket and a topsides supported by the jacket, the topsides comprising one ore more decks. The invention also concerns a method for removal of an offshore platform comprising a jacket and a topsides supported by the jacket.

2. Description of the Prior Art

The installation of offshore platforms is relevant in connection with the development of oil and gas fields at sea.

The removal of offshore platforms, consisting of a jacket and a topsides supported by the jacket, is a field which will become more important in the coming years, with the decommissioning of a number of offshore platforms.

Offshore platforms can be removed by being split up into smaller parts, for example by means of cutting torches or blasting, whereupon each of these smaller parts can be lifted aboard a barge or a ship and transported away. Regardless of how the splitting up is carried out, however, the costs associated with the breaking up and subsequent transport in smaller parts are substantial.

Thus it is a wish to split up a platform which has to be removed into the fewest possible parts, in which case a natural division is to divide it into topsides and jacket, each of which is removed separately. In the case of small platforms with low weight this is relatively problem-free, while in the case of large and heavy platforms it entails lifting with extremely large and expensive crane vessels, if it is even possible at all within the scope of what can be implemented in practice.

The applicant's Norwegian patent applications Nos. 973561, 973562 and 973563 respectively disclose a method and a transporter for installation or removal of a jacket for an offshore platform, a method and a transporter for installation or removal of an offshore platform topsides and a transporter for heavy objects at sea. However, these applications are only describing relevant methods and equipment for handling parts of offshore platforms, such as topsides or jackets. In Norwegian patent application No. 965439 (abandoned before published) there has been decribed a device for such use, comprising a main unit formed by a barge-like structure with adjustable buoyancy, which can be transported, lowered, manouvered and raised in water, characterized in that an auxiliary unit adapted to cooperation with the main unit comprises means for releasable connection to the main unit in at least two different ways, and means for controlling the main unit's functions. This embodiment is not a part of the priority claimed from the above-mentioned Norwegian patent applications Nos. 973561, 973562 and 973563.

Norwegian patent applications No. 973561, 973562 and 973563 disclose methods and transporters which together enable removal of an offshore platform in a favourable way, by splitting the platform in jacket and topsides only and remove these two parts separately. The same methods and transporters may also be used for installation of an offshore platform.

SUMMARY OF THE INVENTION

The object of the invention is to provide a transporter for removal or installation of an offshore platform comprising a jacket and a topsides supported by the jacket, the topsides comprising one ore more decks, which transporter shall be able to carry the jacket and the topsides simultaneously. The object is further to provide a method for removal of an offshore platform comprising a jacket and a topsides supported by the jacket, using the transporter according to the invention, in which method the removal of the topsides shall be followed by the successive removal of the jacket without any need for an intermediate transfer of the topsides to a receiver.

The invention is thus an improvement in relation to Norwegian patent applications Nos. 973561, 973562 and 973563, using the same construction elements in combination. The invention thus consist of a combined transporter comprising features that enables manipulation of both the topsides and the jacket, and carrying out these simultaneously. The invention enables removal of an offshore platform without the use of cranes. The invention also enables simultaneous movement of the topsides and the jacket to a receiver, e.g. a construction yard or a quay, using only one and the same transporter.

Provided a rotation of the topsides is acceptable prior to installation, a method corresponding to the method according to the invention may be used for installation of an offshore platform, with the steps performed in the reverse order. This is a clear variant of the method according to the invention, and will not be explained in detail. It should be understood, however. that the inventive concept also covers this alternative.

Further scope of the applicability of the present invention will become apparent from the, detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be explained in more detail in association with a description of specific embodiments, and with reference to the drawings which are given by way of illustration only, and thus are not limitative of the present invention, and in which.

DETAILED DESCRIPTION OF THE PREFERRED EMBODIMENTS

Figure 1:
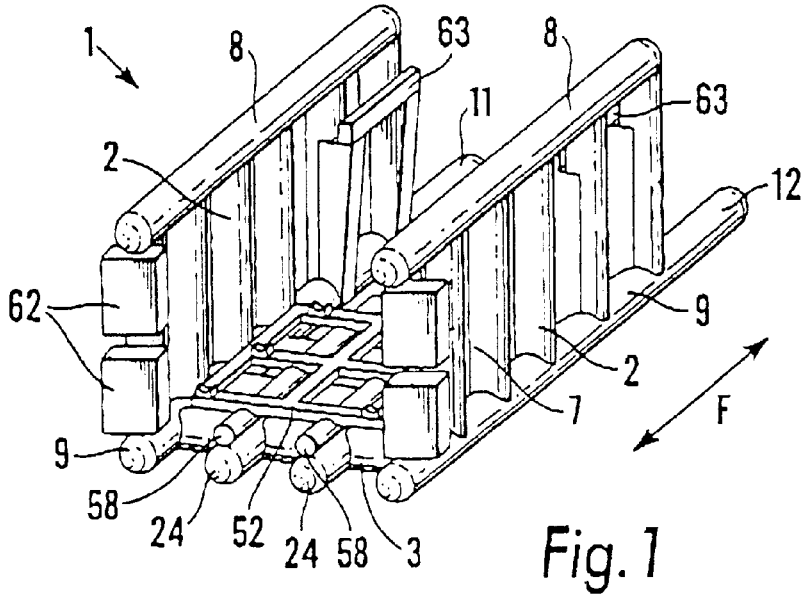
FIG. 1 is a perspective view of a transporter according to the invention.

FIG. 1 illustrates a transporter 1 for installation or removal of an offshore platform according to the invention, comprising a longitudinal underside 3 and a long side 2 arranged on each side of the underside the three sides together thereby forming an oblong structure with a U-shaped cross section.

Lower longitudinal pontoons 9 are arranged in the corner areas between the underside 3 and the long sides 2, and upper longitudinal pontoons 8 are arranged in the long sides' upper sections. Ballasting chambers are provided in each of the ends of the pontoons 8, 9, which ballasting chambers preferably extend in towards the pontoons' central areas. Cross elements 7, which are also in the form of pontoons, containing ballasting chambers, connect the longitudinal pontoons 8, 9.

Together with an open top side, opposite to the underside 3, and two open short sides, the oblong structure forms a body with a prismatic enveloping surface. The ballasting chambers are thereby located in the points of intersection between edge lines formed by the intersections between the surfaces of the long sides 2, the underside 3, the open top side and the open short sides, with the result that a ballasting chamber is arranged in each of the prismatic enveloping surface's eight corners. Thus when ballasting/deballasting the transporter it is possible to rotate it to the desired position in the sea.

Figure 7:
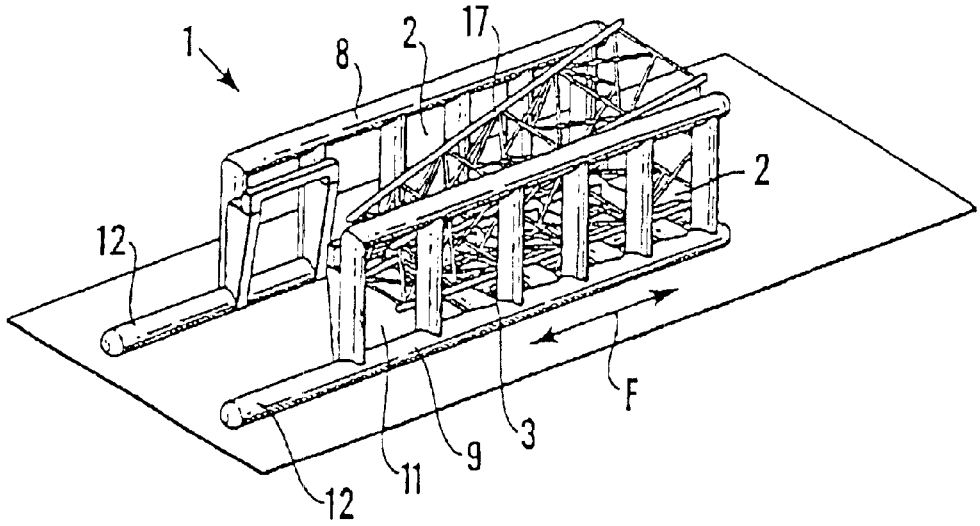

At one end of the transporter the long sides 2 project past the underside 3, thus forming a recess 11 in the underside, see FIG. 7. In the extension of the recess 11 the lower longitudinal pontoons 9 project past the long sides 2 in portions 12.

On each side of the recess 11 there are provided abutment portions adapted to support and lift the topsides of an offshore platform. The abutment portions illustrated in FIG. 1 are formed by two lifting beams or brackets 63, which are structurally joined to the long sides 2 of the oblong structure, i. e. the joint between the abutment portions and the long sides 2 are able to transfer the weight of the topsides from the abutment portions to the long sides. The abutment portions may comprise impact dampening elements (not shown) for the absorption of impact during connection and disconnection of the topsides.

The underside 3 comprises means for securing a jacket 17 (see FIG. 7) in between the long sides 2 and the underside 3, in a position in which the sides of the jacket are adjacent to the long sides 2 and the underside 3 of the transporter. In the embodiment illustrated in FIG. 1 the means for securing the jacket consists of a sliding saddle 52 which is movable in the longitudinal direction F of the transporter. Further, the underside 3 comprises two longitudinal pontoons 24 provided with grooves or rails 58 to carry the sliding saddle 52 and guide its movement. Means for securing the jacket, e. g. brackets may also be provided on the long sides.

The means for securing the jacket 17 to the transporter, i.e. the saddle, may include chains, hooks or clamps which can be bolted to legs or bracing of the jacket. In a simpler design the saddle may be a fixed saddle, without any ability for sliding, or the saddle may be omitted, the jacket being secured directly to the transporter. A sliding saddle enabling moving the jacket in the transporter's longitudinal direction can however be useful for optimizing the position of the transporter's center of gravity, thus permitting the transporter to be located horizontally in the sea during transport. Another advantage of the sliding saddle is the possibility for transferring the jacket to a receiver, e.g. a quay at a construction site, by moving or sliding the saddle with the jacket to the receiver, thereby enabling a transfer of the jacket without the use of costly cranes.

In addition, not shown, the transporter comprises piping, valves, pumps with motors and control equipment for performing the ballasting/deballasting. The ballasting/deballasting are remotely controlled by means of not shown communication equipment. Alternatively, the ballasting/deballasting may be conducted with an umbilical which contains both pressurized water for ballasting and pressurized air for debaflasting, together with pressurized fluid for operation and control of the valves.

The transporter illustrated in FIG. 1 further comprises permanently mounted cutting equipment, illustrated schematically in the form of four boxes 62, for cutting the jacket after it is secured to the sliding saddle. As illustrated in FIG. 1 the cutting equipment 62 on the left side of the transporter is arranged closer to the sliding saddle than the cutting equipment on the right side, which illustrates that the cutting equipment is laterally adjustable to enable it to be adapted to different designs or positions of the jacket.

Figure 2:
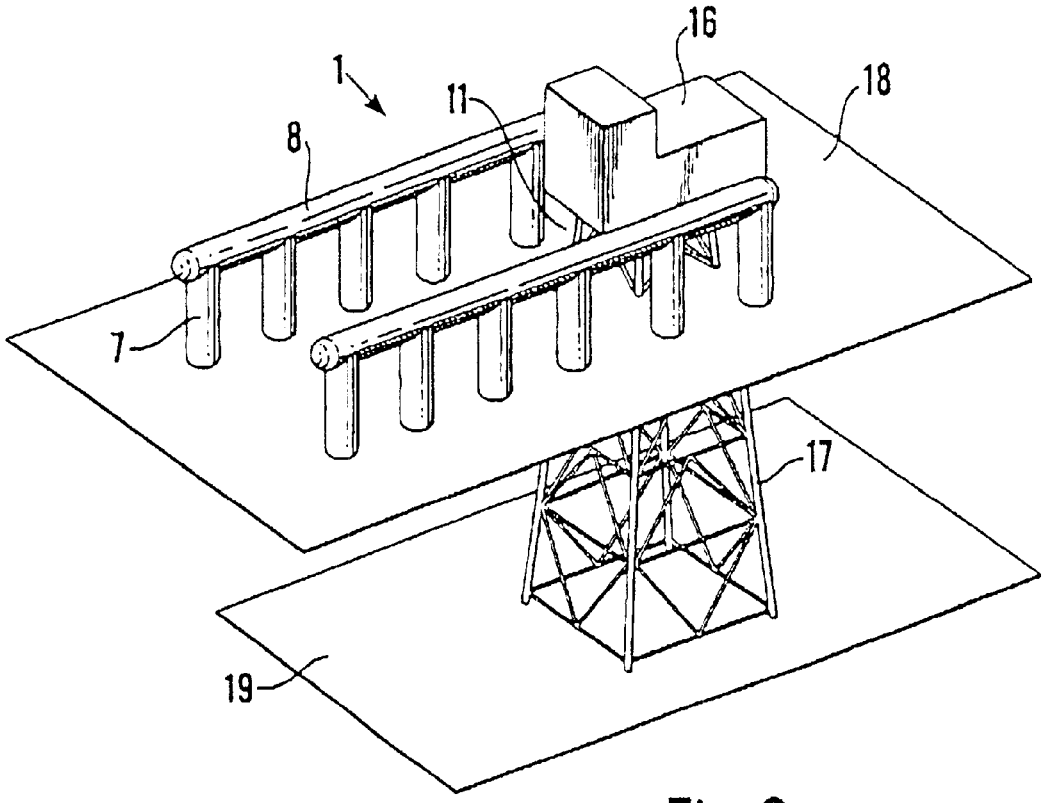
FIGS. 2 and 3 illustrate a removal of a topsides using the transporter according to the invention.

FIG. 2 shows the transporter 1 lying horizontally in the sea 18, ballasted to a position in which the longitudinal underside 3 is facing down and the lower longitudinal pontoons 9 are underneath the sea surface. The transporter is located besides a platform comprising a jacket 17 which is standing in a raised position on the seabed 19 and supports a schematically illustrated topsides 16, which topsides may include one ore more decks.

The transporter in FIG. 2 has been moved into a position underneath the platform topsides 16, the jacket 17 being contained in the recess 11. The actual movement of the transporter will be conducted by tugs. The positioning of the transporter may be carried out by winches which can vary the length of wires between the transporter and the platform jacket or another fixed point.

The transporter is then deballasted and the abutment portions of the transporter, i. e. the lifting beams or brackets 63 (see FIG. 1), are brought into contact with lifting areas of the topsides 16, which lifting areas may be lower support beams of the topsides. The topsides is then securely attached to the transporter, e.g. by chains or clamps, and the transporter is further deballasted, whereby the topsides 16, supported by the lifting beams 63, is lifted off the jacket 17.

Figure 3:
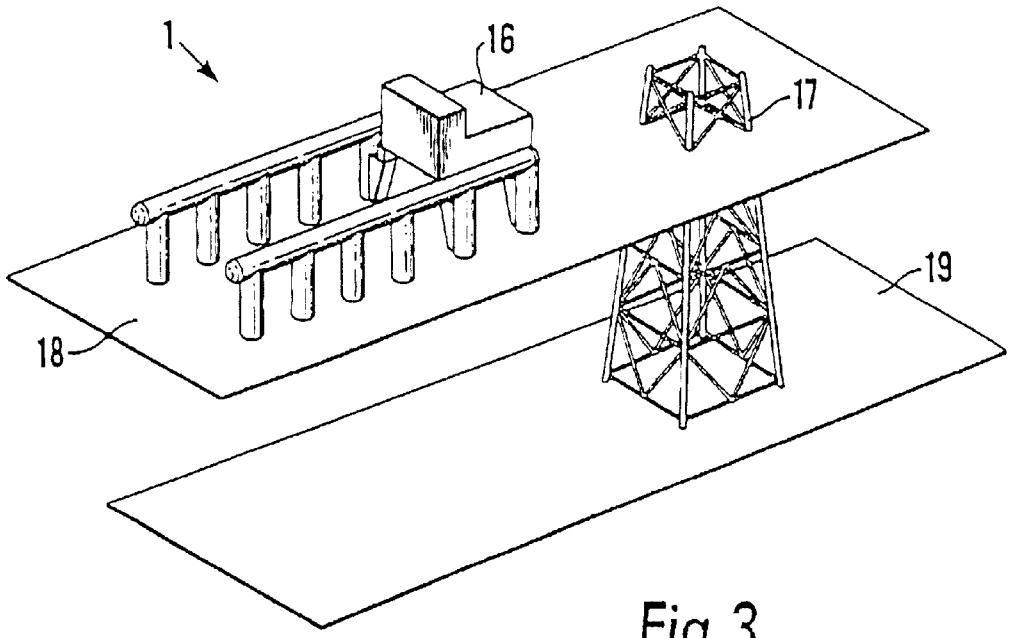

FIG. 3 shows the transporter 1 with the topsides 16 moved away from the jacket 17.

As can be seen from FIGS. 2 and 3, the topsides 16 are located offset from the central region of the transporter, creating an uneven load distribution. The horizontal position of the transporter is achieved by deballasting ballasting chambers in the projecting portions 12 of the longitudinal pontoons 9, creating buoyancy that counteracts bouncy in the opposite side of the transporter.

FIGS. 4–7 show a sequence illustrating removal of a platform jacket from the seabed by a transporter according to the invention. For the sake of simplicity the topsides are not shown in FIGS. 4, 5, 6 or 7. It should however be understood that the topsides may be secured to the transporter as discussed with reference to FIGS. 2 and 3 during the removal of the jacket, which will be discussed below.

Figure 4:
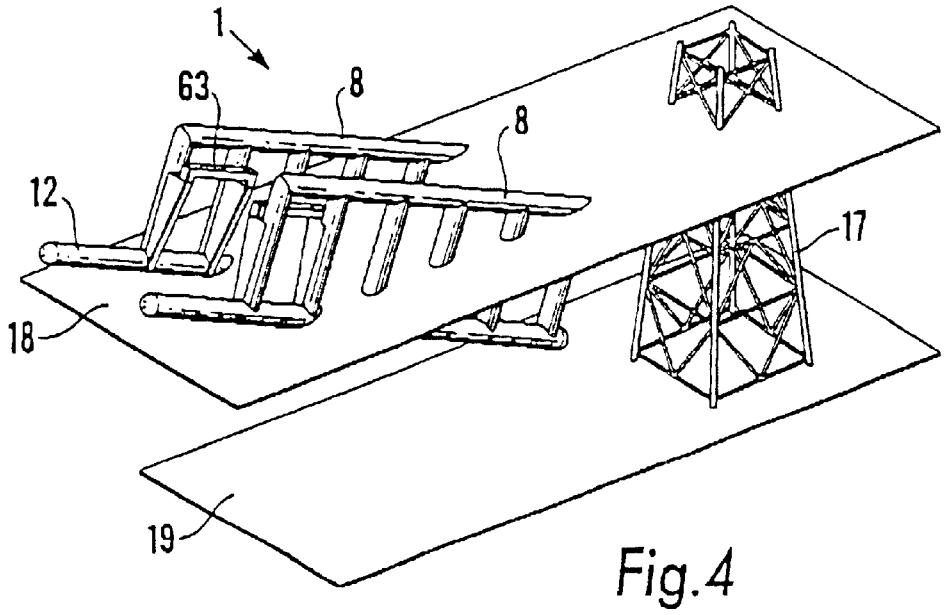
FIGS. 4–7 illustrate a removal of a jacket using the transporter according to the invention.
Figure 5:
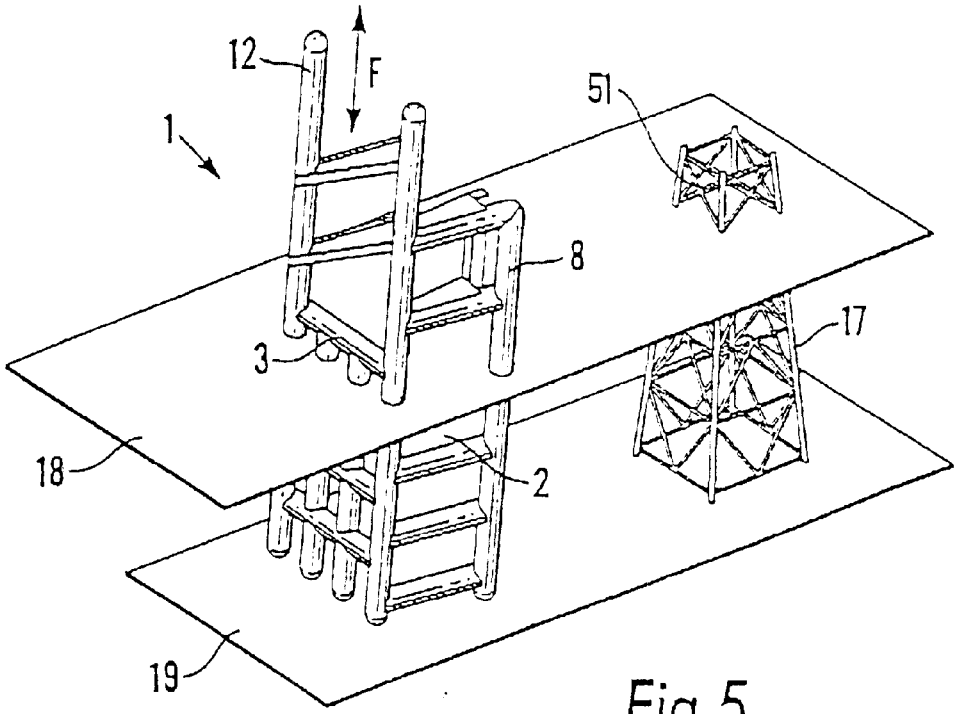

FIG. 4 shows the transporter 1 in a process of by means of ballasting being rotated, and FIG. 5 shows the transporter after completed rotation, into a position in which its longitudinal direction F is essentially vertical. The transporter is located beside the jacket 17, with the underside 3 of the transporter facing away from an outer side 51 of the jacket. The elevation of the topsides 16, if secured to the transporter, must be above the top of the jacket 17.

Figure 6:
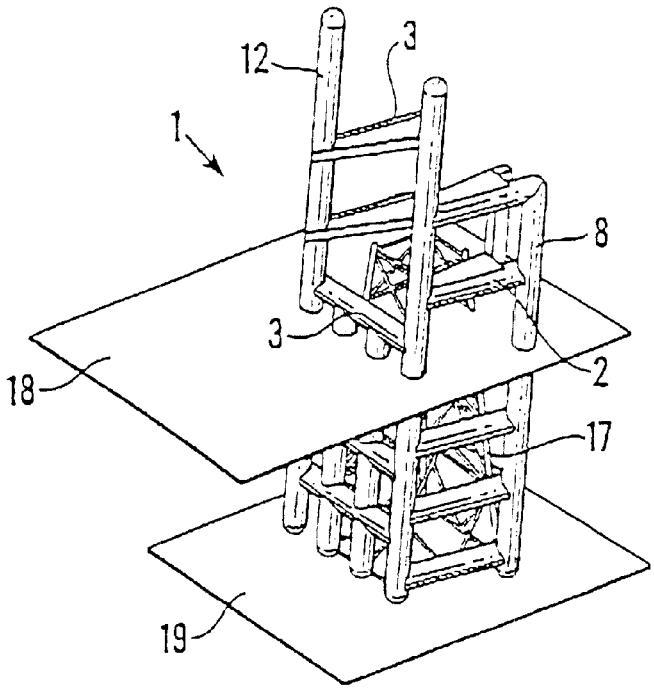

FIG. 6 shows the transporter moved into a position in which the jacket 17 is located in between the long sides 2 and the underside 3 of the transporter. The jacket abuts against the transporter's underside, and is securely attached to the transporter, i. e. the sliding saddle, in a position in which the sides of the jacket are adjacent to the long sides 2 and the underside 3 of the transporter.

The jacket 17 is then released from the seabed 19, e. g. by means of the cutting equipment 62 illustrated in FIG. 1. The transporter with the jacket is thereafter rotated to a horizontal position, which is illustrated in FIG. 7, and moved to a receiver, e.g. a quay of a construction yard. The transfer to the receiver may be carried out by cranes. The transfer of the jacket may however, as discussed above, preferably be carried out by sliding the saddle with the jacket to the receiver.

FIGS. 4–7 thus illustrates a method in which the transporter according to the invention is used for removal of the jacket 17 and the topsides in separate operations, which necessitates an intermediate transfer of the topsides to a receiver.

Figure 8:
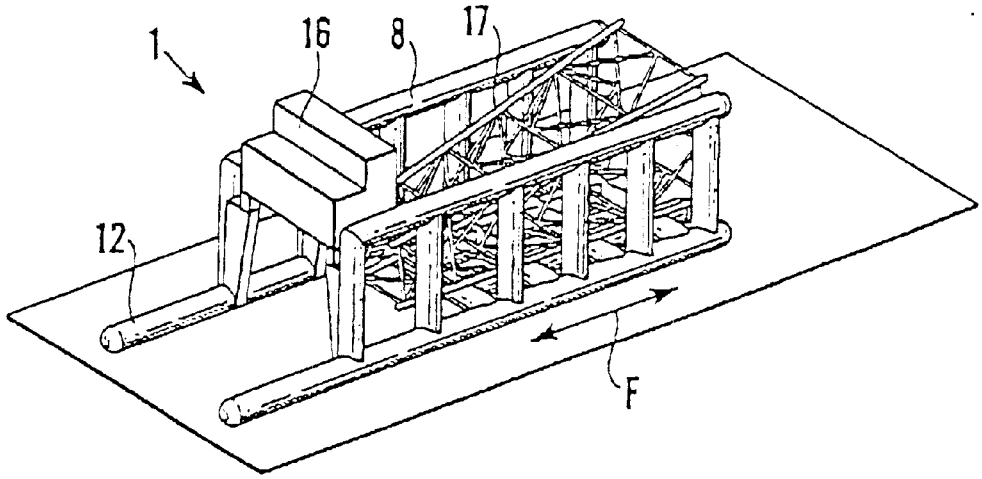
FIG. 8 illustrates a simultaneous transport of a topsides and a jacket using the transporter according to the invention.

FIG. 8 shows the transporter 1 lying horizontally in the sea, carrying simultaneously both the topsides 16 and the jacket 17, for movement to a receiver. FIGS. 4, 5 and 8 thus illustrates a method in which the transporter according to the invention is used for removal of a complete offshore platform comprising a jacket and a topsides, in which method the removal of the topsides is followed by the successive removal of the jacket without any intermediate transfer of the topsides to a receiver.

In both cases, whether the topsides is intermediate transferred to a receiver or not, the jacket 17 may be moved relative to the transporter 1 in the longitudinal direction F to optimize the position of the centre of gravity, which movement preferably is carried out by sliding the saddle in the direction F.

Thus by means of the invention a rational and economically advantageous method for removal of an offshore platform is provided.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A transporter for installation or removal of an offshore platform comprising a jacket and a topsides supported by the jacket, the topsides comprising one or more decks, the transporter having an oblong ballastable structure which is rotatable across the longitudinal direction by ballasting, the oblong structure having two long sides and an intermediate underside that forms a U-shaped cross section, the underside in one end being provided with a recess which, when the transporter in a ballasted position is lying in the sea with the underside horizontally down, is adapted to contain a jacket which is standing in a raised position on the seabed, the transporter further having abutment portions adapted to support and lift the topsides off the jacket when the transporter is deballasted, and that the long sides and/or underside comprises means for securing the jacket in between the long sides and the underside, in a position in which the sides of the jacket are adjacent to the long side and the underside of the transporter.

2. The transporter according to claim 1, wherein the abutment portions are structurally joined to the long sides of the oblong structure.

3. The transporter according to claim 2, wherein the abutment portions have beams or brackets adapted to abut lifting areas of the topsides.

4. The transporter according to claim 2, wherein the abutment portions comprise impact dampening elements.

5. The transporter according to claim 1, wherein the means for securing the jacket comprise a saddle and means for securing the sides of the jacket to the saddle.

6. The transporter according to claim 1, wherein the means for securing the jacket comprise a sliding saddle which is movable in the longitudinal direction of the oblong structure and comprises means for securing the jacket.

7. The transporter according to claim 1, wherein the long sides and the underside are structurally joined by longitudinal pontoons.

8. The transporter according to claim 7, wherein the longitudinal pontoons comprises longitudinally projecting portions projecting past the long sides in extension of the recess.

9. A method for removal of an offshore platform comprising a jacket and a topsides supported by the jacket, using a transporter, the method comprising the following steps:

a) the transporter is ballasted to a position in which an underside is lying horizontally down in the sea, the transporter is moved underneath the platform topsides into a position in which the jacket is located in a recess, the transporter is deballasted and abutment portions of the transporter are brought into contact with lifting areas of the topsides, the topsides is securely attached to the transporter, and the transporter is further deballasted, whereby the topsides is lifted off the jacket, b) the transporter is rotated and raised by deballasting into a position in which its longitudinal direction is essentially vertical and the elevation of the topsides is above the top of the jacket, c) the transporter with the topsides is moved into a position in which the jacket is located in between the long sides and the underside of the transporter, the jacket is securely attached to the transporter, the jacket is released from the seabed, d) the transporter carrying the topsides and the jacket is moved to a receiver.

10. The method according to claim 9, wherein during step c) or d) the jacket is moved relative to the transporter in the longitudinal direction to optimize the position of the center of gravity.

11. The method according to claim 9, comprising the step of using a transporter having an oblong ballastable structure which is rotatable across the longitudinal direction by ballasting, the oblong structure comprises two long sides and an intermediate underside that forms a U-shaped cross section, the underside in one end is provided with a recess which, when the transporter in a ballasted position is lying in the sea with the underside horizontally down, is adapted to contain a jacket which is standing in a raised position on the seabed, the transporter further comprises abutment portions adapted to support and lift the topsides off the jacket when the transporter is deballasted, and the long sides and/or underside comprise means for securing the jacket in between the long sides and the underside, in a position in which the sides of the jacket are adjacent to the long sides and the underside of the transporter.

12. The method according to claim 9, wherein the step of the transporter carrying the topsides and the jacket to the receiver is simultaneously carried out.

13. The method according to claim 9, wherein the step of the transporter carrying the topsides and the jacket to the receiver is sequentially carried out.

14. The method according to claim 13, wherein the topsides is first carried to the receiver and then the jacket is carried to the receiver.

15. A portion of a disassembled offshore platform including at least one of a jacket and topsides produced in accordance with the steps of claim 9.

16. A method for removal of an offshore platform having at least one of a jacket and a topsides supported by the jacket, the method comprising the steps of:

using a transporter for the removal;

ballasting the transporter to a position in which an underside is lying horizontally down in the sea;

moving the transporter underneath the platform topsides into a position in which the jacket is located in a recess, deballasting the transporter and the abutment portions of the transporter which are brought into contact with lifting areas of the topsides, the topsides being securely attached to the transporter;

further deballasting the transporter whereby the topsides is lifted off the jacket;

rotating and raising the transporter by deballasting into a position in which its longitudinal direction is essentially vertical and the elevation of the topsides is above the top of the jacket; and moving the topsides by the transporter to a receiver.

17. The method according to claim 16, further comprising the steps of:

moving the transporter into a position in which the jacket is located in between the long sides and the underside of the transporter;

securely attaching the jacket to the transporter, the jacket being released from the seabed; and moving the jacket by the transporter to a receiver.

18. The method according to claim 17, wherein the step of the transporter moving the topsides to the receiver and the step of the transporter moving the jacket to the receiver are simultaneously carried out.

19. The method according to claim 17, wherein the step of the transporter moving the topsides to the receiver and the step of the transporter moving the jacket to the receiver are sequentially carried out.

20. The method according to claim 19, wherein the topsides is first moved to the receiver and then the jacket is moved to the receiver.

21. The method according to claim 16, wherein the step of using a transporter, includes the step of using a transporter having an oblong ballastable structure which is rotatable across the longitudinal direction by ballasting, the oblong structure comprises two long sides and an intermediate underside that forms a U-shaped cross section, the underside in one end is provided with a recess which, when the transporter in a ballasted position is lying in the sea with the underside horizontally down, is adapted to contain a jacket which is standing in a raised position on the seabed, the transporter further comprises abutment portions adapted to support and lift the topsides off the jacket when the transporter is deballasted, and the long sides and/or underside comprise means for securing the jacket in between the long sides and the underside, in a position in which the sides of the jacket are adjacent to the long sides and the underside of the transporter.

22. The method according to claim 17, wherein the jacket is moved relative to the transporter in the longitudinal direction to optimize a position of a center of gravity during at least one of the following steps:

the step of moving the transporter into a position in which the jacket is located in between the long sides and the underside of the transporter; and the step of moving the jacket by the transporter to a receiver.

23. A portion of a disassembled offshore platform including at least one of a jacket and topsides produced in accordance with the steps of claim 16.

24. A method for removal of an offshore platform having at least one of a jacket and a topsides supported by the jacket, the method comprising the steps of:

using a transporter for the removal;

moving the transporter into a position in which the jacket is located in between the long sides and the underside of the transporter;

securely attaching the jacket to the transporter, the jacket being released from the seabed; and moving the jacket by the transporter to a receiver, the method further comprising the steps of:

ballasting the transporter to a position in which an underside is lying horizontally down in the sea;

moving the transporter underneath the platform topsides into a position in which the jacket is located in a recess, deballasting the transporter and the abutment portions of the transporter which are brought into contact with lifting areas of the topsides, the topsides being securely attached to the transporter;

further deballasting the transporter whereby the topsides is lifted off the jacket;

rotating and raising the transporter by deballasting into a position in which its longitudinal direction is essentially vertical and the elevation of the topsides is above the top of the jacket; and moving the topsides by the transporter to a receiver.

25. The method according to claim 24, wherein the step of the transporter moving the topsides to the receiver and the step of the transporter moving the jacket to the receiver are simultaneously carried out.

26. The method according to claim 24, wherein the step of the transporter moving the topsides to the receiver and the step of the transporter moving the jacket to the receiver are sequentially carried out.

27. The method according to claim 26, wherein the topsides is first moved to the receiver and then the jacket is moved to the receiver.

28. The method according to claim 24, wherein the step of using a transporter, includes the step of using a transporter having an oblong ballastable structure which is rotatable across the longitudinal direction by ballasting, the oblong structure comprises two long sides and an intermediate underside that forms a U-shaped cross section, the underside in one end is provided with a recess which, when the transporter in a ballasted position is lying in the sea with the underside horizontally down, is adapted to contain a jacket which is standing in a raised position on the seabed, the transporter further comprises abutment portions adapted to support and lift the topsides off the jacket when the transporter is deballasted, and the long sides and/or underside comprise means for securing the jacket in between the long sides and the underside, in a position in which the sides of the jacket are adjacent to the long sides and the underside of the transporter.

29. The method according to claim 24, wherein the jacket is moved relative to the transporter in the longitudinal direction to optimize a position of a center of gravity during at least one of the following steps:

the step of moving the transporter into a position in which the jacket is located in between the long sides and the underside of the transporter; and the step of moving the jacket by the transporter to a receiver.

30. A portion of a disassembled offshore platform including at least one of a jacket and topsides produced in accordance with the steps of claim 24.

* * * * *